United States Patent [19]

Connolly et al.

[11] Patent Number: 5,062,329

[45] Date of Patent: Nov. 5, 1991

[54] LEAF TAMPER FOR CHIPPER/SHREDDER

[75] Inventors: Kevin J. Connolly, Ballston Lake; James M. D'Aleo, Clifton Park, both of N.Y.; Clifford J. Griffith, Clemmons, N.C.

[73] Assignee: Garden Way Incorporated, Troy, N.Y.

[21] Appl. No.: 554,202

[22] Filed: Jul. 17, 1990

[51] Int. Cl.[5] ..... B25B 33/00

[52] U.S. Cl. ..... 81/488; 241/169.2

[58] Field of Search ..... 81/488; 241/169.2

[56] References Cited

U.S. PATENT DOCUMENTS

| | | | |
|---|---|---|---|
| 2,066,997 | 1/1937 | Mueller | 81/488 |
| 3,088,345 | 5/1963 | Campbell | 81/488 |
| 3,765,275 | 10/1973 | Johnson | 81/488 |
| 3,895,548 | 7/1975 | Sauve | 81/488 |

*Primary Examiner*—James G. Smith

*Attorney, Agent, or Firm*—Hayes & Reinsmith

[57] ABSTRACT

A tamping tool having a pushing member configured for insertion into a hopper throat of a chipper/shredder device. An operator engageable handle is formed to an end of the pushing member, and a stop is formed intermediate the length of the pushing member for engagement with a hopper of the chipper/shredder to limit the distance the member may be inserted into the hopper throat, the position of the stop being selected to prevent the engagement of the tool with the pulverizing elements of the chipper shredder. A hook is provided on the handle for convenient storage of the tool on the hopper.

8 Claims, 4 Drawing Sheets

LEAF TAMPER FOR CHIPPER/SHREDDER

TECHNICAL FIELD

This invention relates to equipment for use with landscaping devices generally referred to as a chipper/shredder, and more particularly to a tamping tool for pushing light, bulky materials towards the pulverizing and macerating elements of the chipper/shredder.

BACKGROUND OF THE INVENTION

Chipper/Shredders are well known garden and landscape accessories used to reduce a variety of items such as leaves, twigs, small braches, cardboard, etc. to small pieces. Typically, a chipper/shredder is provided with a hopper to receive the materials to be shredded, macerated or otherwise reduced and a hopper throat to guide the material towards high speed, rotating pulverizing or macerating elements (chipping/shredding elements). For purposes of ease of understanding the term shredder and the term chipper/shredder are intended to include devices which pulverize and/or macerate such garden waste and the elements, such as flails, which actually do the "work".

A flexible rubber barrier (flap) may be provided near the top of the hopper throat as a protective barrier to prevent unwanted items from reaching the elements and to prevent material being shreded by the elements from inadvertantly being thrown back out of the hopper.

A problem with the aforementioned design is that light, bulky materials such as dry leaves, straw and twigs may not have sufficient weight to deflect the barrier or to overcome the "funnel effect" of the throat and reach the chipping/shredding elements, and therefore, extra force is required to push the materials past the barrier and through the throat to reach the elements. It is, of coures, unacceptable for an operator to manually force the materials through the barrier because of potential injuries.

It is a primary object of the invention to provide a tamping tool for pushing light or bulky materials in a hopper of a chipper/shredder towards the chipper/shredder elements, which tool is both safe and easy to operate;

It is another object of the invention to provide a tamping tool which is low in cost, safe to use and strong, durable and lightweight;

It is a further object of the invention to provide a tamping tool having a safety stop which prevents the tool from contacting the chipper/shredder elements of the machine;

It is another object of the invention to provide a tamping tool having a pair of handles for increased pushing force and inherently safe two hand operation and handle grips which provide a convenient, confortable and secure grip;

It is a further object of the invention to provide a tamping tool having a built-in structure for easily keeping the tool the hopper of the chipper/shredder;

Other objects will be in part obvious and in part pointed out in more detail hereinafter.

A better understanding of the objects, advantages, features, properties and relations of the invention will be obtained from the following descriptions and accompanying drawings which set forth certain illustrative embodiments and are indicative of the various ways in which the principles of the invention are employed.

SUMMARY OF THE INVENTION

A tamping tool constructed according to the present invention comprises, in its preferred embodiments, a pushing member configured for insertion into a hopper throat of a chipper/shredder, an operator engageable handle formed to an end of the member, and a stop formed intermediate the length of the member for engagement with a hopper of the chipper/shredder to limit the distance the member may be inserted into the hopper throat, the position of the stop being selected to prevent the engagement of the tool with the pulverizing elements oe mecerating elements of the chipper/shredder.

In further accord with the invention, a hook may be provided on the handle for convenient storage of the tool on the hopper or other convenient location on the chipper shredder.

In still further accord with the invention, a second handle may be provided to encourage two-hand operation of the tool.

DESCRIPTION OF A PERFERRED EMBODIMENT

The tamping tool of the present invention is particularly well suited for use with a chipper/shredder device such as the TOMAHAWK chipper/shredder manufactured by Garden Way Incorporated, Troy, N.Y. The tamping tool may be used for pushing light, bulky materials in a hopper of a chipper/shredder device, through a resiliant barrier (flap) and a hopper throat of the device and towards high speed, rotating pulverizing and macerating elements (elements) of the device.

Figure 1:
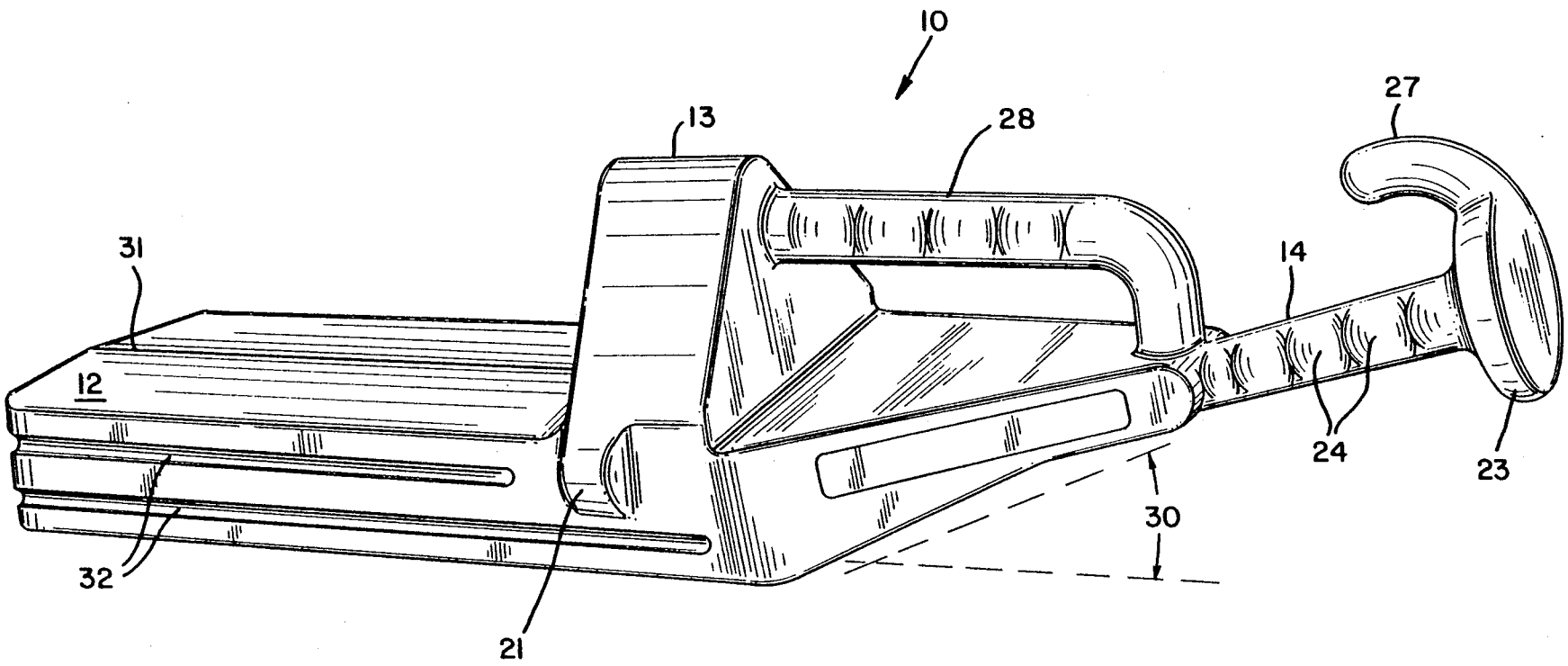
FIG. 1 is a perspective view of a tamping tool constructed according to the present invention.
Figure 2:
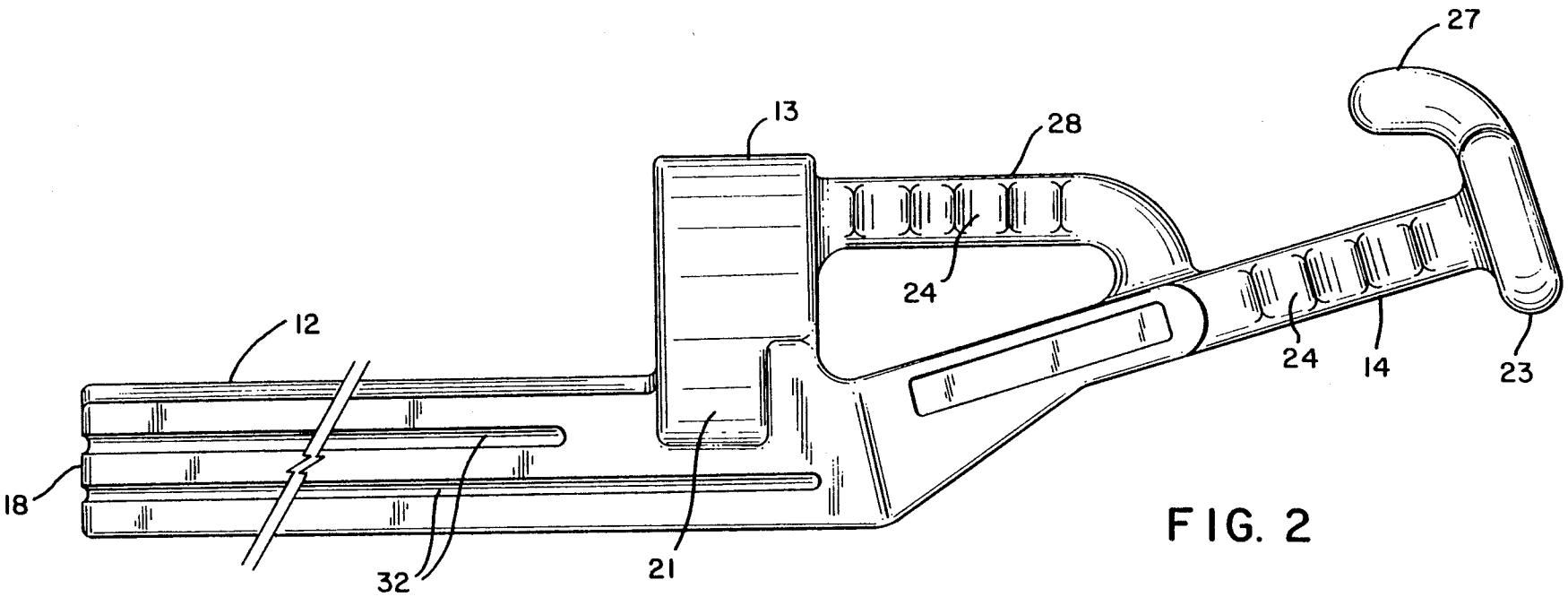
FIG. 2 is a side view of the tamping tool of FIG. 1.
Figure 3:
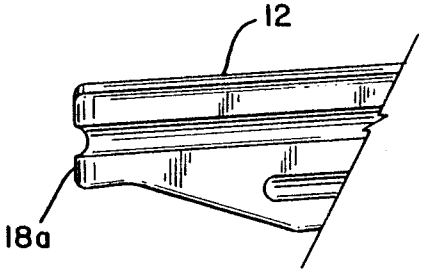
FIG. 3 is a side view of an alternative embodiment of a working end of the tamping tool of FIG. 1.
Figure 6:
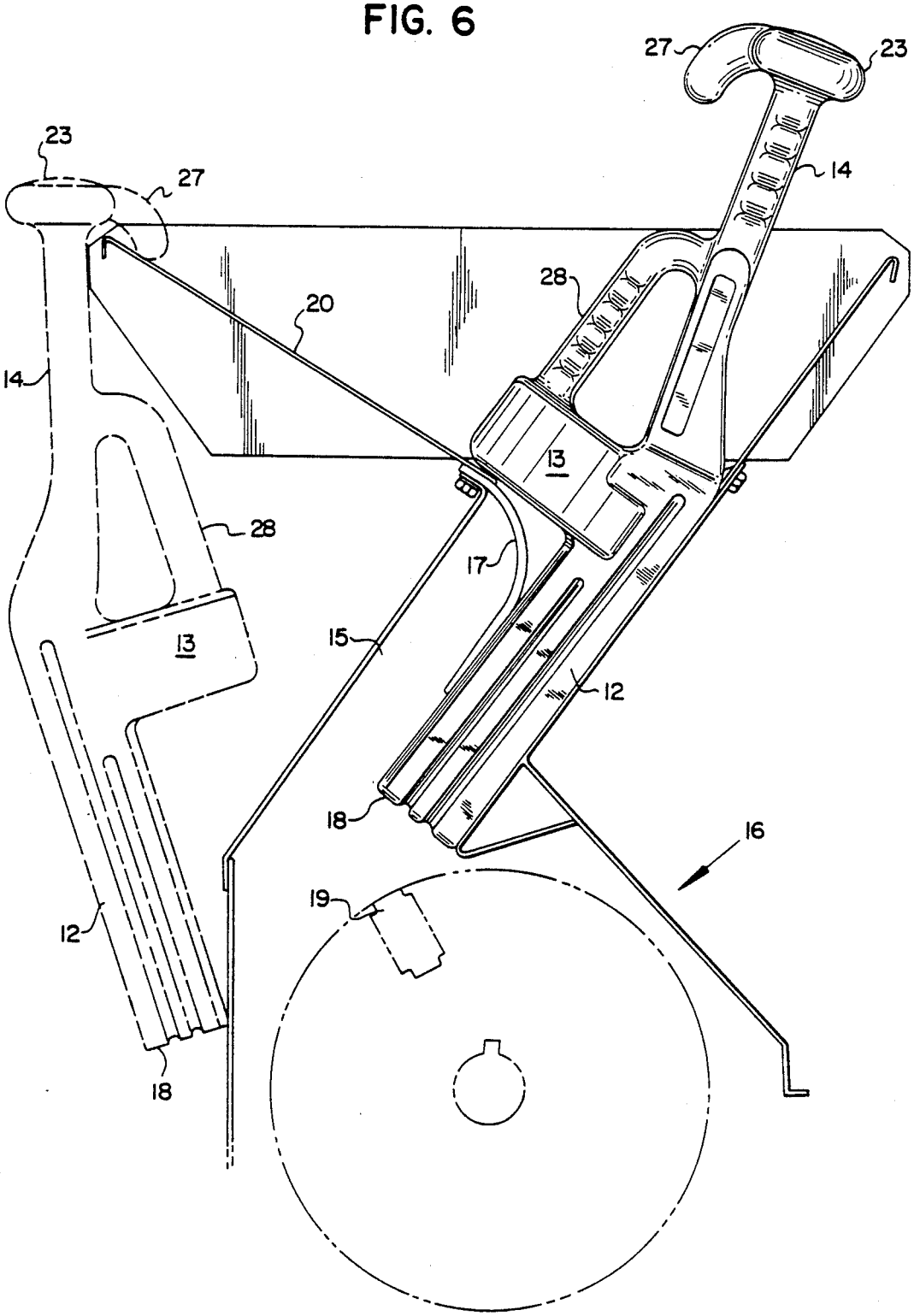
FIG. 6 is a perspective view of the tamping tool of FIG. 1 inserted into a hopper and hopper throat of a suitable chipper/shredder, the chipper/shredder being shown in cross section.

Refering particulary to FIGS. 1, 2 and 6, the tamping tool of the invention is generally indicated by numeral 10 and comprises a pushing member 12, a safety stop 13, and an operator engagable handle 14. The pushing member 12 is generally rectangular in shape and is configured to be received in a correspondly shaped hopper throat 15 of a chipper/shredder device 16. By virtue of the pushing member 12 construction, movement of the member within the throat is generally limited to slidable movement. The tamping tool is therefore particularly useful for pushing materials (not shown) through a resilient barrier (flap) 17 at the top of the throat 15 of a typical chipper shredder and down into the throat. The working end 18 of the pushing member 12 contacts the mass of materials to be pushed through the hopper throat 15 towards the rotating elements 19 of the chipper/shredder 16. An alternative construction of the working end **18*a* is illustrated in FIG. 3**.

Referring to FIGS. 1, 2, 4 and 6, a safety stop 13 is formed intermediate the length of pushing member 12, and engages the hopper 20 of the chipper/shredder 16 to limit the distance that the pushing member may be inserted past the flap 17 and into the hopper throat 15, thereby to prevent engagement of working end 18 with elements 19 of the chipper/shredder 16. The safety stop 13 extends generally perpendicular to the pushing member 12, and the height of the safety stop is selected to ensure reliable safety engagement of the stop with the hopper 20. An alternative construction of the safety stop is shown at 13*a* of FIG. 5.

Figure 4:
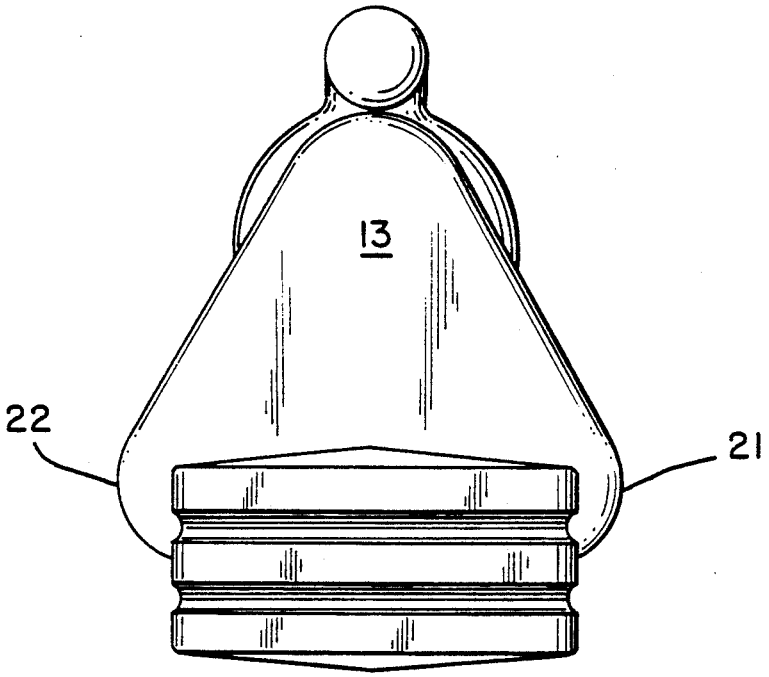
FIG. 4 is an end view of the tamping tool of FIG. 1.
Figure 5:
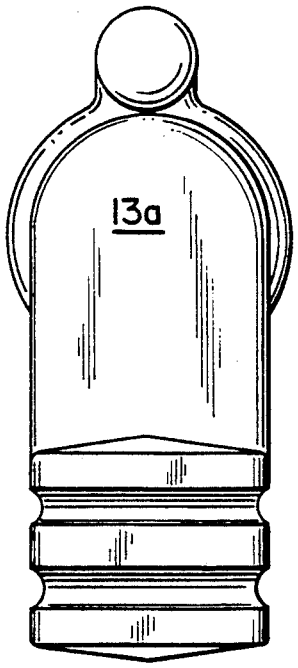
FIG. 5 is an end view of an alternative embodiment of the tamping tool of FIG. 1.

Referring to FIGS. 1, 2 and 4, a pair of secondary safety stops 21, 22 are provided to improve the reliability of preventing the working end 18 from contacting the elements 19. The secondary stops 21, 22 extend generally perpendicular from the sides of the pushing member adjacent the safety stop 13 and engage the sides of hopper 20 to limit the distance that the pushing member may be inserted into the hopper throat.

It will be understood that the positioning of the safety stops 13, 21, 22 on the pushing member 12 represent very important variables for the porper operation of the tool 10. If the distance that the pushing member may be inserted into the throat 15 is too short, compacted materials may build up and plug the opening to the elements 19. However, it is equally important that the stops reliably prevents the working end 18 from contacting the elements to prevent damage to the elements and the pushing member and also to prevent injury to the operator.

Referring to FIGS. 1, 2 and 6, the operator engageable handle 14 is fixed to an end of the pushing member opposing the working end 18. A knob 23 may be formed on that end of the handle 14 to aid in forcing material into the throat 15. The handle may also be provided with a plurality of diametrically opposed grooves 24 configured for receiving the individual fingers on the hands of the operator to provide a comfortable and secure grip. Additionally, a hook 27 is formed on the end of the handle 14 for hanging the tool 10 on the side of the hopper 20 as shown in phantom in FIG. 6.

A second handle 28 may be formed between the first handle 14 and the stop 13. The second handle 28 allows for two hand operation of the tool 10 when additional force is required to push the mass of materials through the throat 15 while insuring maximum operator safety.

The tool is perferably manufactured of polyethylene. Molded ridges 31, and/or channels 32 are formed in the body of the pushing member 12 for strength and structural integrity.

Although the invention has been illustrated and described with respect to an exemplary embodiment thereof, it should be understood by those skilled in the art that various other changes, ommisions and additions may be made therein and thereto, without departing from the spirit and scope of the invention.

We claim:

1. A tamping tool for pushing materials contained in a hopper of a chipper/shredder device through a throat of predetermined, fixed, non-circular cross section of the hopper and towards high speed, rotating pulverizing elements of the device, comprising:

a pushing member having a working end configured for insertion into said hopper throat for pushing materials contained in said hopper into said hopper throat and towards said pulverizing elements, said member having a non circular cross section that closely engages at least a portion of the throat to preclude rotation of the member in said hopper throat thereby allowing only slideable pushing movement of said member in said throat;

an operator engageable handle on an end of said member; and a safety stop intermediate the length of said member for engagement with said hopper to limit the distance said member may be inserted into said throat, said stop precluding engagement of said working end with said pulverizing elements.

2. The tamping tool of claim 1 further comprising a second operator engageable handle on said end of the pushing member for two hand operation of said tool.

3. The tamping tool of claim 1 further comprising a hook on said handle for hanging said tool on said hopper.

4. The tamping tool of claim 1 wherein said handle is in angular relation to said pushing member.

5. The tamping tool of claim 4 wherein said angle is between 10 and 30 degrees.

6. The tamping tool of claim 2 further comprising a plurality of pairs of diametrically opposed grooves on said handles for engagement with individual fingers on the hands of an operator using said tool.

7. The tamping tool of claim 1 further comprising a knob formed on an end of said handle opposing said pushing member.

8. The tamping tool of claim 1 further comprising a pair of secondary stops formed adjacent to said safety stop on diametrically opposed sides of said pushing member.

* * * * *